United States Patent [19]

McCrea

[11] Patent Number: 4,655,428

[45] Date of Patent: Apr. 7, 1987

[54] SUPPORT FOR A FRAME, PLAQUE OR THE LIKE

[76] Inventor: Charles McCrea, P.O. Box 149, Bohemia, N.Y. 11716

[21] Appl. No.: 817,042

[22] Filed: Jan. 8, 1986

[51] Int. Cl.[4] ..... A47G 1/16

[52] U.S. Cl. ..... 248/470; 40/152.1; 248/456

[58] Field of Search ..... 248/470, 455, 456, 460, 248/126, 489, 498, 496; 40/152.1, 155, 152.2; 70/389, 420, 454

[56] References Cited

U.S. PATENT DOCUMENTS

| | | | |
|---|---|---|---|
| 676,450 | 6/1901 | Schwartz | 70/454 |
| 3,251,572 | 5/1966 | Klitzner | 248/470 X |
| 3,707,791 | 1/1973 | Levy | 40/152.1 X |
| 3,865,342 | 2/1975 | Kanzelberger | 40/152.1 X |
| 4,212,122 | 7/1980 | Reim | 40/152.1 |
| 4,229,892 | 10/1980 | Hueter et al. | 248/470 X |
| 4,290,216 | 9/1981 | Gale | 248/470 X |
| 4,432,152 | 2/1984 | Daenen | 40/152.1 |
| 4,441,268 | 4/1984 | Scott | 40/152.1 |
| 4,515,338 | 5/1985 | Schneider | 248/460 |

*Primary Examiner*—Ramon O. Ramirez

*Attorney, Agent, or Firm*—Roberts, Spiecens & Cohen

[57] ABSTRACT

A support for a frame plaque or the like in which the article is supplied with two spaced plastic inserts of the same construction. Each insert is provided with a bore having a limited access such that a hook-like protrusion on a stand can be inserted into the bore of one of the inserts whereafter the stand is rotated to bring the hook-like attachment into engagement with a socket-like arrangement included within the bore. The plastic insert can thus be used for bracing the article in upright position and as an alternative the insert can be used for hanging the article from a vertical wall or the like.

16 Claims, 4 Drawing Figures

SUPPORT FOR A FRAME, PLAQUE OR THE LIKE

FIELD OF INVENTION

This invention relates to structures which can be braced in upright position such as, for example, plaques, photographic frames and the like planar structures, although the invention is not limited to the bracing of planar structures alone. The invention also relates to the provision of inserts suitable for attachment to articles which may be selectively suspended from a vertical wall or the like or which may be braced in upright position on a flat horizontal surface or the like.

BACKGROUND OF THE INVENTION

In the display of pictures, plaques or other similar articles that may or may not be ornamental in appearance, it is sometimes desirable to be able to place the article either on a horizontal surface, such as a desk or a wall, whereat the article is braced in upright position or, in the alternative, to suspend the article from a vertical surface such as a wall.

There are numerous patents which relate to structures for supporting articles on flat surfaces which may be horizontal or vertical and which deal either exclusively with one type of surface or the other, or which deal with both types of supporting surfaces. Some of these patents include U.S. Pat. Nos. 2,992,464; 3,251,572; 3,865,342; 4,212,122; 4,229,892; and 4,441,268.

In U.S. Pat. No. 3,865,342, J. Kanzelberger discloses a support for a picture frame or the like which is capable of being hung on a wall, or which may rest on a surface. The support includes a strap having a hole in one end for providing a hanger support. The other end of the strap is adapted for being bent away from the article to be supported to give an easel-type support. Between the two ends of the strap is provided a slot for receiving a friction-holding device. The strap can be rotated off center in either clockwise or counterclockwise direction to compensate for unbalanced picture frames or plaques. The strap may also be moved relative to the fastening device to permit vertical adjustment of the strap in relation to the plaque.

In U.S. Pat. No. 4,441,268, is revealed a picture framing device embodying dovetailed elements which enable supporting a picture frame in either of two upright positions. Dovetail elements of male construction are insertable within female dovetail elements to provide a connection between the bracing device and the article to be supported.

O. Hueter shows in U.S. Pat. No. 4,229,892 a display device having a frame-holder provided with a support member. The display device can be supported as a free-standing element by engaging the support member to an adapter.

In U.S. Pat. No. 3,251,572, W. Klitzner shows a structure involving relatively few components, which structure is adapted for use by movement of an attachment which is secured to the rear of the article to be displayed. The attachment includes a support member that is mounted for slidable movement in a bracket and which has a particular construction and configuration for the location thereof in one of two positions whereby the article may be mounted on either a horizontal or a vertical surface as required.

SUMMARY OF THE INVENTION

As will be seen in the description which follows hereinafter, none of the aforegoing patents, nor any other structure, which I am aware of, reveals the particular construction of the present invention and it is an object of the present invention to provide a new and unique arrangement for mounting various types of device in either braced upright position on a horizontal surface or in a suspended position hanging from a vertical wall, or the like.

It is yet another object of the invention to provide for an improved insert suitable for use with plaques and like constructions, whereby such inserts may be readily installed by utilization of mass production techniques in accommodating bores in predetermined alignment such as to facilitate utilization thereof.

Another object of the invention is to provide improved structures for plaques and like planar elements such that these planar elements may be readily stacked in a pile without being inconveniently displaced by associated bracing structures.

In achieving the above and other objects of the invention, there is provided in a general sense a structure comprising a braceable means adapted for being selectively suspended from a suspending device, or supported in standing position on a supporting surface and a receptacle inserted into such braceable article and provided with an opening whereby to enable hookingly engaging and suspending the braceable article. Furthermore, there is provided a key arrangement insertable through the opening into the receptacle. This key arrangement includes a first section receivable within the receptacle and a second section extending from the receptacle to constitute a brace or an easel-like support for the braceable article. The receptacle and key arrangement include cooperating parts, whereby the key arrangement is rotatable between first and second postures in one of which the first section of the key arrangement is insertable into the receptacle for rotation therein and in the other of which the key arrangement is locked in the receptacle with the second section in a position to brace the braceable article in standing position on the supporting surface.

According to a feature of the invention, a locking arrangement is provided in the receptacle to engage the first section of the key arrangement upon rotation of the latter and to hold the first section and thereby the key arrangement in fixed posture. This locking arrangement may include at least one pair of extensions within the receptacle to receive and straddle the first section upon rotation of the latter to appropriate position. The receptacle preferably includes a wall defining an inner cylindrical bore and the locking arrange- ment preferably includes substantially diametrically opposed pairs of extensions on and extending inwardly of the aforesaid wall. One of the extensions of each pair is, according to a preferred embodiment of the invention, shorter than the other extension therein to permit rotation of the first section of the key arrangement past the shorter extension of each pair into abutting relationship with the other extension of each pair and thereby to be straddled by the extensions of each pair.

According to another feature of the invention, there may be provided an annular flange on and encircling the aforesaid wall and lying against the braceable article. The wall may moreover be provided with a cutout and the braceable article will preferably be provided with a bore having a shape corresponding to that of the wall with the cutout therein, whereby to enable aligning the receptacle in predetermined relationship in the bore in the braceable article.

According to yet another feature of the invention, a flat wall is included which covers about one-half of the bore of the wall thereby to limit the first section to the first posture upon and until complete insertion of the first section into the receptacle. This flat wall preferably has a serrated edge extending generally diametrically across the bore of the wall. According to another feature of the invention, the shorter extension of each pair is flexible and moreover the extensions are arranged generally perpendicularly with respect to the aforesaid serrated edge.

According to still a further feature of the invention, the second section of the key arrangement has a longitudinal extent of at least about three times the thickness of the braceable article and the first section is arranged as a hook-like appendage on the second section. Additionally, and in accordance with still further features of the invention, pointed protrusions may be provided on the aforesaid wall externally of the same whereby to enable a firm engagement of the receptacle in the braceable article.

In accordance with still another aspect of the invention, the aforesaid objects and advantages as well as structural features may be obtained and embodied in an insert which is provided for utilization with planar structures. Such insert will, by way of example and as described in greater detail hereinafter, comprise a body defining a cylindrical bore having an entry end and including a wall closing off a part of the entry end to leave a limited access opening to permit limited access into the bore. This body, in accordance with the invention, will further include a socket arrangement extending into the bore in offset relationship to the access opening to receive an object which is to be inserted through the access opening and which is thereafter rotated to be received by the socket arrangement.

The above and other objects, advantages and features of the invention will be found in the detailed description which follows hereinbelow as illustrated in the accompanying drawing.

DETAILED DESCRIPTION OF DRAWING

Figure 1:
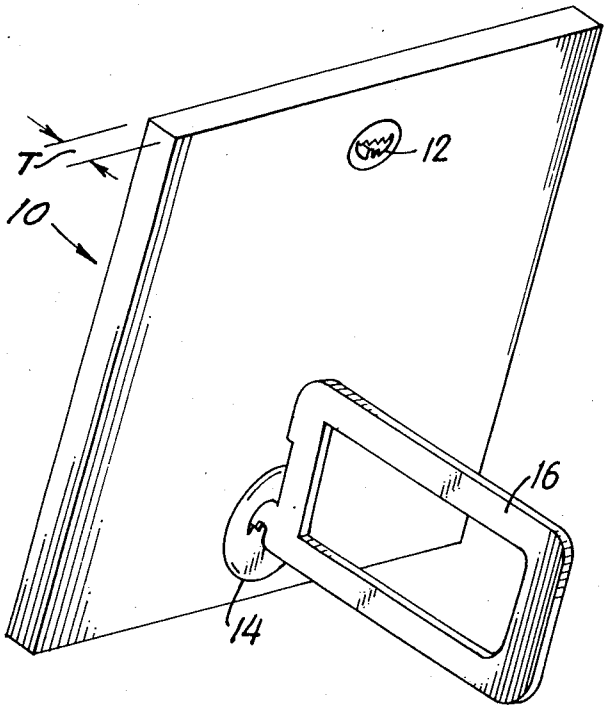
FIG. 1 is a perspective view from the rear of a plaque provided with inserts and a bracing easel-type structure in accordance with one embodiment of the invention.

In FIG. 1 is illustrated in perspective rear view a braceable object or article 10. This braceable object may, for example, be of planar configuration. Other shapes are as well contemplated within the scope of the invention. Examples of braceable articles include plaques, picture frames, point of sale advertising boards and various other types of structures which are susceptible of being braced by easel-type bracing structures in upright attitude or posture on a horizontal surface or the like, or which may be selectively suspended by suspending devices such as hooks from vertical supporting structures such as walls, or the like. As has been indicated above, it is an object of the invention to provide for the above selective types of support as may be required while providing at the same time that the bracing structure is detachable so that the articles may be piled one on top of the other without interference from the bracing structure. The invention also provides for ease in attachment of the bracing structure and for relatively strong attachment of the same to the article to be braced so that detachment does not inadvertently occur to the distress of the user.

In FIG. 1 are furthermore seen two like inserts 12 and 14. In insert 14 has been inserted a section of the bracing structure 16. Nothing has been inserted or coupled to the insert 12 which may be utilized for hanging the article 10 from a wall. As an alternative, the article 10 may be turned upside down and a bracing structure such as indicated at 16 coupled to the same.

Figure 2:
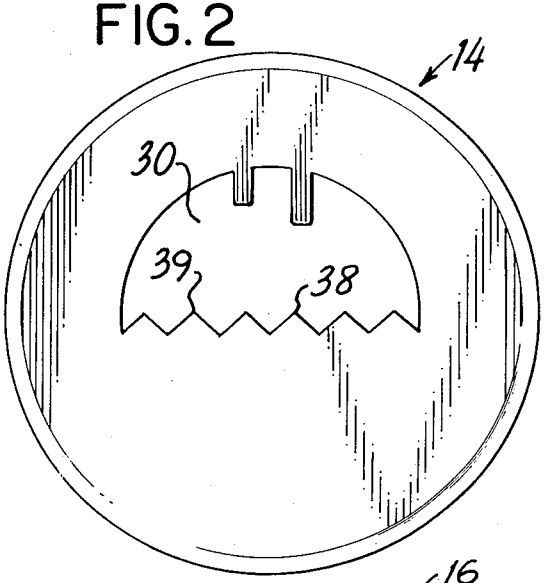
FIG. 2 is a rear view of the insert employed in the embodiment of FIG. 1.
Figure 3:
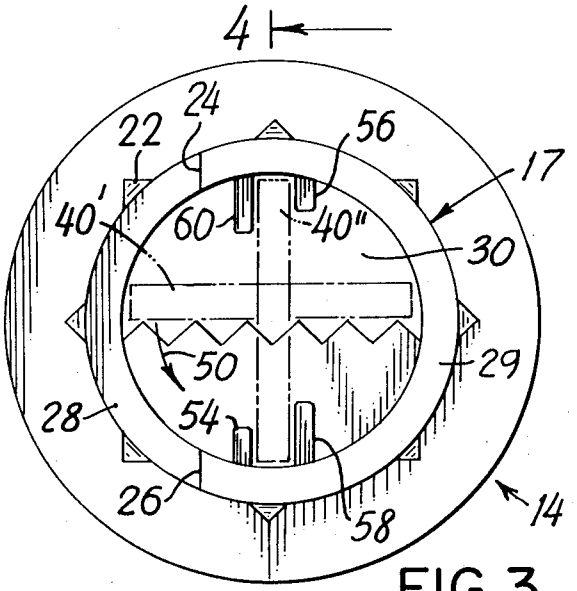
FIG. 3 is a front view of the insert illustrated in FIG. 2.
Figure 4:
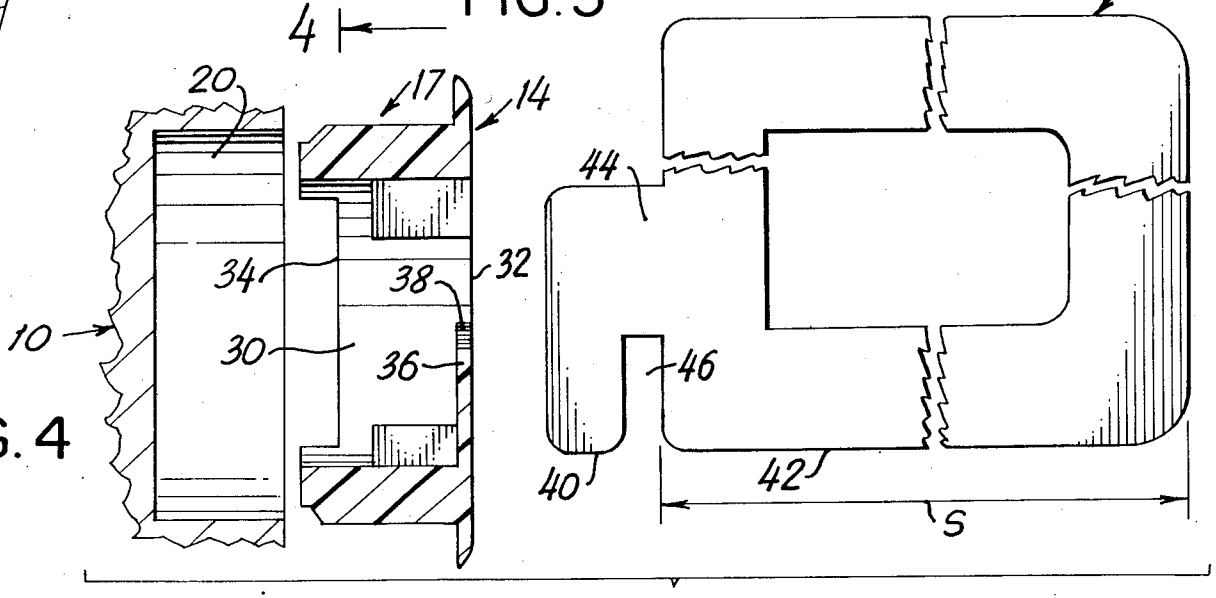
FIG. 4 illustrates the insert of FIGS. 2 and 3 in cross-section along line IV—IV in FIG. 3 in potentially cooperative arrangement with a bracing easel-type structure.

FIGS. 2–4 show the details of insert 14 by way of example, and FIG. 4 particularly shows the insert 14 in potentially cooperative relationship with the bracing structure 16. From these views, it will be seen that the insert 14 includes a torroidal wall or body 17 which is adapted for being inserted into a corresponding bore 20 in the wall article 10. To assure that a tight connection is made between the insert 14 and the article 10, the wall or body 17 is provided with a plurality of ribs 22 of triangular or pointed cross-section whereby a tooth-like grip is effected between the insert 14 and the associated article 10. Moreover, the wall 17 is provided with shoulders 24 and 26 in turn providing for a cutout section 28. In other words, there is a step between the cutout section 28 and the balance 29 of the wall 17. The bore 20 in the article 10 is provided with a like configuration as a result of which a single alignment only is provided in a rotational sense between the insert and the bore into which the insert is to be positioned.

The wall 17 defines an interior bore 30. This bore has an entry end indicated at 32 (see FIG. 4) and an end 34 distal with respect thereto. A wall 36 closes off approximately one-half of the opening of the bore 30 at entry end 32. This permits limited access to the bore as will be explained in greater detail hereinbelow. It should be noted that the wall 36 is provided with an edge 38. The edge 38 is serrated and thus the edge 38 has a plurality of teeth such as indicated at 39. One of the purposes of these teeth is to provide for rigorous engagement with a hooking device, or the like, such that the article 10 may be provided with firm engagement with the hooking device in order to be firmly and hookingly engaged when held in suspended relationship on a vertical wall.

As appears in FIG. 4, the bracing structure 16 consists of a first section 40 and a second section 42. The first section 40 constitutes a hook-like appendage on the second section 42 to which it is attached by a root 44 and from which it is separated by means of a slot 46. The second section 42 has a longitudinal extent indicated at S which is in the order of magnitude of at least about three times the thickness T (see FIG. 1) of the article 10. This enables an adequate easel-like support to permit bracing the article 10 in upright position.

The sections 40 and 42 cooperatively constitute a key arrangement intended to engage in the key receptacle constituted by the bore 30. As seen in FIG. 3, the first section 40 is indicated at 40' in horizontal relationship or, in other words, in parallel to the edge 38. This enables the section 40 to be inserted past the wall 36 and thus into the bore 30. Thereafter, the section 40 as well-,as the section 42 by which it is manipulated, is rotated in the direction indicated by the arrow 50. The section 40 is thus rotated to the position indicated at 40''.

As the section 40 is rotated from the position indicated at 40' to the position indicated at 40'', it moves from a horizontal posture to a vertical posture. In so doing, it first encounters walls 54 and 56. Wall 54 forms a pair with wall 58. Wall 56 forms a pair with wall 60. Collectively, these two pairs of walls form a socket device to receive the section 40 of bracing structure 16 and to lock the same in position. Wall 54 is flexible and is shorter than wall 58 in order to permit the entry of section 40 between the walls of this pair. The shorter wall 54 is upstream of the wall 58 relative to the direction of movement indicated by arrow 50. Similarly, walls 56 and 60 which are arranged in mirror image relationship with respect to walls 54 and 58 constitute a socket or locking arrangement which receives the other extremity of the section 40 as the section 40 is rotated into position in the manner indicated by arrow 50. It should be noted that the wall 36 is accommodated by slot 46 and that the section 40 is retained in the bore by operation of wall 36 as well as by socket or locking arrangements constituted by the two pairs of walls comprising walls 50, 56, 58 and 60, all as discussed hereinabove.

It is to be understood that the insert 14 is a monolithic plastic construction formed of a suitable plastic of commercially available type. It is also to be understood that the insert may be automatically installed into the article 10 or the like by an automatic installation device employing mass production techniques. As an alternative thereto, inserts such as insert 14 may be provided separately and may be installed by the user under whose control the bracing structure 16 is also inserted.

From the above, it will now be clear that the invention involves the provision of an insert for a planar structure or the like, which insert comprises a body defining a cylindrical bore or the functional equivalent thereof having an entry end and including a wall closing off a part of the entry end to leave a limited access into the bore. The body further includes a socket arrangement extending into the bore and constituted by the walls 54, 56, 58 and 60 in offset relationship to the access opening to receive an object which is inserted through the access opening and which is constituted by the section 40. This section is thereafter rotated to be received by the socket or locking arrangement. By "offset" relationship as mentioned hereinabove, reference is made to the relationship of the edge 38 which is illustrated as being horizontal and the arrangement of the walls 54, 56, 58 and 60 which are spaced parallel members arranged in vertical attitude.

As has been noted above, the edge 38 is serrated and the purpose of this is to provide for a rigorous hooking engagement as has been indicated as being one of the purposes of the invention.

There will now be obvious to those skilled in the art many modifications and variations of the structures set forth hereinabove. These modifications and variations will not depart from the scope of the invention if defined by the following claims.

What is claimed is:

1. A structure comprising braceable means adapted for being selectively suspended from a suspending device or supported in standing position on a supporting surface, a receptacle inserted into said braceable means and provided with an opening whereby to enable hookingly engaging and suspending said braceable means, and key means insertable through said opening into said receptacle, said key means including a first section receivable within the receptacle and a second section extending from said receptacle to constitute a brace for said means, said receptacle and key means including cooperating means whereby the key means is rotatable between first and second postures in one of which the first section of the key means is insertable into the receptacle for rotation therein and in the other of which the key means is locked in the receptacle with the second section in a position to brace the braceable means in standing position on the supporting surface, and locking means in said receptacle to engage the first section of the key means upon rotation of the latter and to hold the first section and thereby said key means in fixed posture, said receptacle including a wall defining an inner cylindrical bore and said locking means including substantially diametrically opposed pairs of extension on and extending inwardly of said wall.

2. A structure as claimed in claim 1 wherein one of the extensions of each pair is shorter than the other extension therein to permit rotation of the first section of the key means past the shorter extension of each pair into abutting relation with the other extension of each pair.

3. A structure as claimed in claim 2 comprising an annular flange on and encircling said wall and lying against said braceable means.

4. A structure as claimed in claim 2 wherein said wall is provided with a cutout and said braceable means is provided with a bore having a shape corresponding to that of the wall with said cutout whereby to align the receptacle in predetermined relationship in the bore in the braceable means.

5. A structure as claimed in claim 2 comprising a flat wall covering about one-half of the bore of said wall thereby to limit the first section to said first posture upon and until complete insertion of the first section into the receptacle.

6. A structure as claimed in claim 5 wherein the flat wall has a serrated edge extending generally diametrically across the bore of said wall.

7. A structure as claimed in claim 2 wherein the shorter extension of each pair is flexible.

8. A structure as claimed in claim 2 wherein the second section of the key means has a longitudinal extent of at least about three times the thickness of the braceable means and the first section is a hook-like appendage on the second section.

9. A structure as claimed in claim 2 comprising pointed protrusions on said wall externally of the same whereby to enable a firm engagement of the receptacle in the braceable means.

10. A structure as claimed in claim 6 wherein the extensions are aligned substantially perpendicular to said edge.

11. A structure as claimed in claim 10 wherein said wall is provided with a cutout and said braceable means is provided with a bore having a shape corresponding to that of the wall with said cutout whereby to align the receptacle in predetermined relationship in the bore in the braceable means.

12. A structure as claimed in claim 11 wherein said cutout defines a plane perpendicular to said edge.

13. An insert for a planar structure comprising a body defining a cylindrical bore having an entry end and including a wall closing off a part of said entry end to leave a limited access opening to permit limited access into said bore, said body further including socket means extending into said bore in offset relationship to said access opening to receive an object which is inserted through said access opening and which is thereafter rotated to be received by said socket means, said wall having an edge postioned substantially diametrically in said bore and said socket means including a pair of spaced parallel extensions extending from said body into said bore at an angle relative to said edge.

14. A structure as claimed in claim 13 wherein said edge is serrated.

15. A structure as claimed in claim 13 wherein said socket means includes a second pair of spaced parallel extensions in said bore in mirror relation to the first said pair.

16. A structure as claimed in claim 15 wherein each pair of extensions includes one extension which is shorter than the other extension.

* * * * *